US005123226A

United States Patent [19]

Near

[11] Patent Number: 5,123,226

[45] Date of Patent: Jun. 23, 1992

[54] SYSTEM FOR SEALING CIGARETTE PACKAGES

[76] Inventor: Michael A. Near, Rte. 6, Box 161, Lucy Averette Rd., Oxford, N.C. 27565

[21] Appl. No.: 682,365

[22] Filed: Apr. 9, 1991

[51] Int. Cl.[5] ..... B65B 57/08; B65B 51/14

[52] U.S. Cl. ..... 53/75; 53/234; 53/375.9; 74/568 R; 74/838; 156/350; 156/359

[58] Field of Search ..... 53/75, 77, 54, 55, 371.7, 53/375.9, 376.8, 374.9, 225, 234; 156/350, 358, 359, 583.1; 74/568 R, 838

[56] References Cited

U.S. PATENT DOCUMENTS

| | | | |
|---|---|---|---|
| 3,979,88 | 9/1976 | Seragnoli | 53/77 |
| 3,692,611 | 9/1972 | Kühnle | 156/359 X |
| 3,982,380 | 9/1976 | Seragnoli | 53/77 |
| 3,984,963 | 10/1976 | Seragnoli | 53/77 |
| 4,134,502 | 1/1979 | Seragnoli | 53/54 X |
| 4,330,977 | 5/1982 | Focke | 53/371.7 |
| 4,502,908 | 3/1985 | Von Wichert et al. | 53/75 X |
| 4,585,503 | 4/1986 | Von Wichert et al. | 53/75 X |
| 4,829,752 | 5/1989 | Focke et al. | 156/359 X |

*Primary Examiner*—Horace M. Culver
*Attorney, Agent, or Firm*—Richard C. Litman

[57] ABSTRACT

A system is disclosed for sealing thermoplastic transparent overwraps on packages, in particular cigarette packages, using axially shiftable cylindrical cams enabling variable contact times dependent upon variable rotational speeds of the driving shaft of the overwrap machine as transferred to the cam support shafts. An encoder reads the rotational speed of each cylindrical cam and sends a signal representing that speed to a programmable controller which in turn sends a signal representative of an axial position of the cylindrical cam corresponding to the rotational speed to a reversible servo motor which functions to axially shift the cam support shaft to shift the cam relative to a cam follower. This in turn changes the dwell time of the cam follower and accordingly the contact time between the cam-controlled heater and the seam to be sealed over a variable range, while enabling the contact pressure and the temperature of the heater to remain constant. The servo motor rotates a threaded screw which translates a nut operatively connected to the cam support shaft to in turn shift the cam support shaft and the cam. Similar mechanisms control the contact time of both the heater for sealing the side seam and the heaters for sealing the end seams.

4 Claims, 3 Drawing Sheets

SYSTEM FOR SEALING CIGARETTE PACKAGES

BACKGROUND OF THE INVENTION

1. Field of the Invention

This invention relates generally to wrapping or packaging machines, and more particularly to a device for controlling the sealing of thermoplastic overwraps, i.e., to overwrapping machines whose task is to wrap in sheets of transparent plastic, products such as cigarettes previously packed in wraps that are essentially parallelepiped in shape.

2. Description of Related Prior Art

Conventionally, cigarette packages are wrapped and sealed in sheets of transparent plastic material such as "cellophane" or polypropylene on overwrapping machines. The plastic materials are heat-sealable by heating elements which are cam-actuated to engage the cigarette package along the side and ends thereof.

The process of wrapping cigarette packages with polypropylene film has been automated by several types of machinery over the years. The most dominant and successful of all designs is the G. D 4350. This is an Italian machine of particularly good quality and design. The G. D 4350 machine performs its function smoothly and reliably. The operation of this machine is described in a series of patents issued to Enzo Seragnoli including U.S. Pat. No. 3,967,767 issued Jul. 6, 1976, U.S. Pat. No. 3,979,881 issued Sep. 14, 1976, U.S. Pat. No. 3,982,380 issued Sep. 28, 1976, U.S. Pat. No. 3,984,963 issued Oct. 12, 1976 and U.S. Pat. No. 4,134,502 issued Jan. 16, 1979. Other patents dealing with the process of wrapping cigarette packages with plastic film include U.S. Pat. No. 4,330,977 issued to Heinz Fock on May 25, 1982, and U.S. Pat. No. 4,585,503 issued to Nils Von Wickert and Jurgen Steinhauer on Apr. 29, 1986. There are, however, shortcomings in the heat seal area that become more obvious under close inspection.

The action of sealing polypropylene film is controlled by three factors. These factors are 1) contact pressure, 2) heat, and 3) contact time. The contact pressure is fixed by the setting and alignment of the heaters themselves combined with the in/out stroke generated by a cam lift. The heat should remain relatively constant through the control loop created by a thermocoupling and thermostatic voltage controller. That leaves the third factor of contact time.

As the machine increases or decreases in RPM speed, the time value for each revolution will fluctuate as well. This fluctuation will vary the actual clock time value that the heaters touch the film. As a direct result, the increase in clock time for contact that occurs at lower speeds will burn the film. The working temperature for heat-sealing polypropylene is approximately in the range of 125–165 degrees C. Because it is impossible to rapidly change the heat value or contact pressure the only factor left to vary is, of course, the contact time.

The G. D 4350 machine makes an attempt at regulating the contact time to the lower RPM values by having a dual-faced cam design. One face of this cam set is configured to operate at the higher machine function speeds (about 360–400 RPM). At these higher speeds, the contact time has been set at about 1/10th of one second. At this value, the heat range for the heaters can be set at about 140 degrees C. Of course, the factor of heat has a negative effect on the moisture content of the cigarettes. As the machine slows to below 180 RPM the cam faces shift to allow a shorter contact time. This reduced contact time value allows the heater face to contact the cigarette package for a shorter clock time. This clock time, however, has proven to be incorrect for most low-speed values.

Since the G. D 4350 cam face design allows for only two distinct contact time dwell values, it is not adequate to the task. My improvement provides for a coordinated contact time value more precisely matched with the RPM of the machine over its entire operating range.

SUMMARY AND OBJECTS OF THE INVENTION

It is an object of this invention to provide a system for sealing cigarette packages which varies the contact time of heaters used to seal polypropylene or other thermoplastic film while maintaining the temperature at a constant level.

It is a further object of this invention to vary the contact time of heaters in a system for sealing cigarette packages over a range of contact times corresponding to the range of variation in RPM of the main drive shaft of the sealing machine.

These and other objects are achieved by providing a conventional overwrapping machine with an encoder, a logic circuit or programmable controller, a servo motor, and at least one unique cam and controls therefor to be substituted for the conventional cams originally provided the overwrapping machine. The unique cam is mounted on a shaft driven to rotate about its longitudinal axis by a timing belt connected to the main shaft of the machine. Also mounted to read the RPM of the camshaft is an encoder which sends a signal representative of the RPM of the camshaft to the logic circuit or programmable controller. The cam, in addition to being rotatable with the camshaft, is axially shiftable with the camshaft under the control of a nut which is translatable along a rotatable screw driven by a bi-directional servo motor. The servo motor is responsive to a signal generated by the logic circuit or programmable controller in response to the RPM signal generated by the encoder. The cam profile includes a helix which extends from the 27° to the 210° position, thereby providing a continuously variable high and low profile between these two positions. A cam follower, which controls the contact time of a heater, tracking from a high to a low portion of the cam surface, will vary the contact time of the heater in accordance with the longitudinal position of the cam, which in turn depends upon the RPM signal generated by the encoder. It is contemplated that in the preferred embodiment two cams will be provided, one cam controlling the contact time of one heater for sealing along a longitudinal edge of the cigarette package, and the second cam controlling the contact time of second heaters for sealing the ends of the cigarette package.

Other objects, features and advantages of this invention will become apparent from the following detailed description and the appended claims, reference being had to the accompanying drawings forming a part of the specification, wherein like reference numerals, designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description and not limitation.

Figure 1:
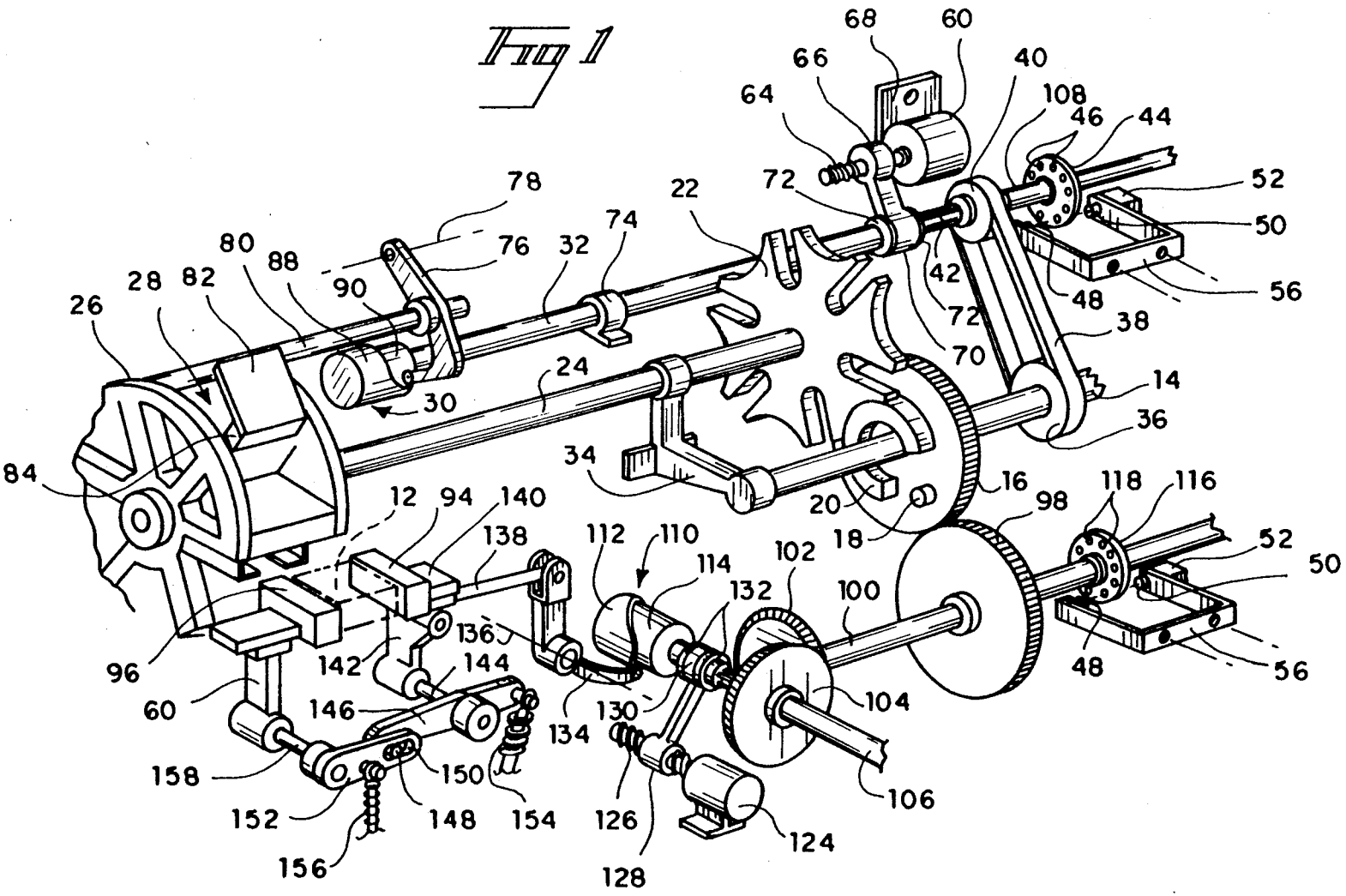
FIG. 1 is a perspective view of an overwrapping machine with the inventive system incorporated therein.

Turning now to FIG. 1, there is shown an overwrapping machine 10 having the inventive system for sealing cigarette packages 12 incorporated therein. Reference numeral 14 designates the main driving shaft for overwrapping machine 10, driven by a motor (not shown). Keyed to shaft 14 is a gearwheel 16 having on one side thereof a drive pin 18 and a centering device 20 for driving and controlling Geneva gear 22, which is fixedly mounted on shaft 24. Also mounted on shaft 24 is a wrapping wheel 26 which makes one forward movement or 60° step clockwise followed by a halt each time shaft 14 makes one counterclockwise turn.

Wrapping wheel 26 has six radial compartments 28. When one of these compartments 28, when halted by Geneva gear 22, is at a receiving station (not shown), a cigarette package 12 together with a transparent sheet to form an outer wrap are inserted into the compartment and the transparent sheet is wrapped about the package in preparation for heat sealing. In prior art devices, control of heat sealing has depended upon varying the contact pressure, heat, and contact time. In the machine shown in FIG. 1, contact time was varied in the prior art by providing two heating devices controlled by two cams, and raising one of the two heating devices out of contact with the cigarette package when shaft 14 was rotating at a slower speed. The arrangement allowed an accurate contact time for only two fixed speeds of rotation of drive shaft 14, with the contact time at other speeds being inaccurate, leading to either an incomplete seal or a seal which burned the transparent wrap.

In the embodiment shown in FIG. 1, a variable cam 30 and controls therefor have been substituted for the cam arrangements of the prior art. Cam 30 is mounted on shaft 32 which is both rotatable and axially translatable. Drive shaft 14, which is supported in part by bearing support 34 as is shaft 24, has pulley 36 fixedly mounted thereon. Pulley 36 drives timing belt 38 which in turn drives pulley 40 keyed by key 42 to shaft 32 so as to rotatably drive shaft 32 while permitting shaft 32 to axially translate relative to pulley 40.

Figure 2:
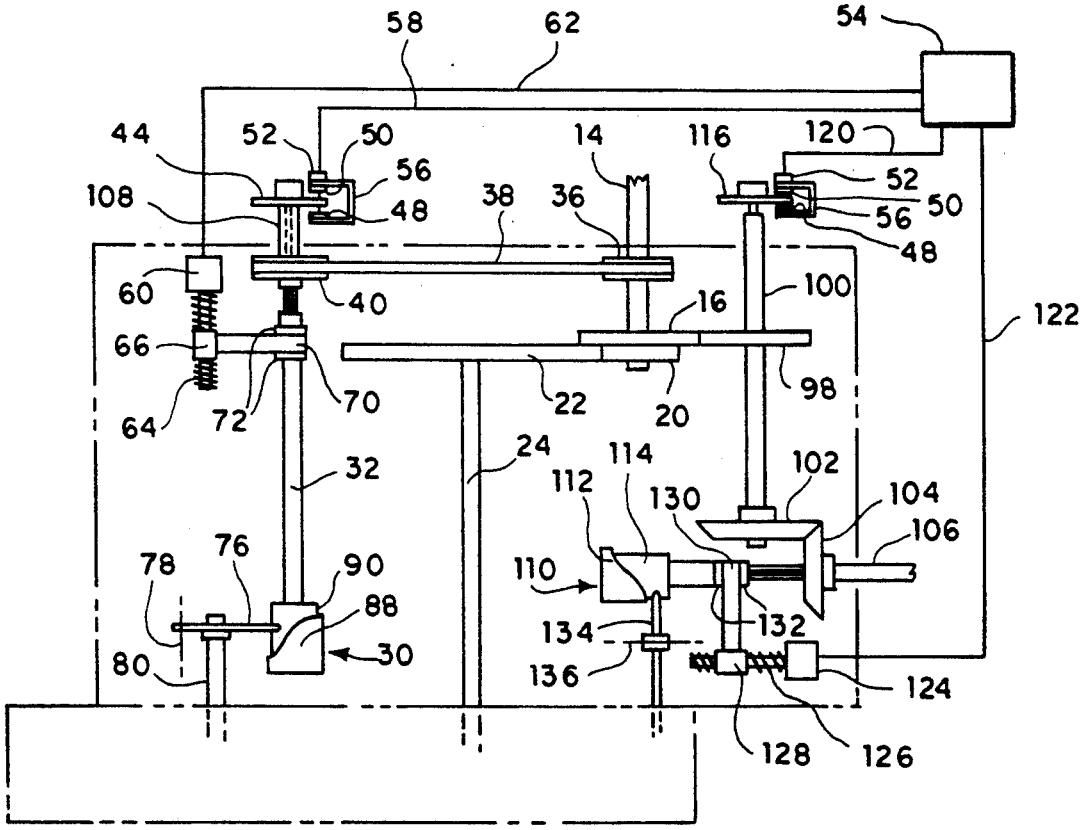
FIG. 2 is a plan view showing the inventive system together with the controlling circuitry therefor.
Figure 3:
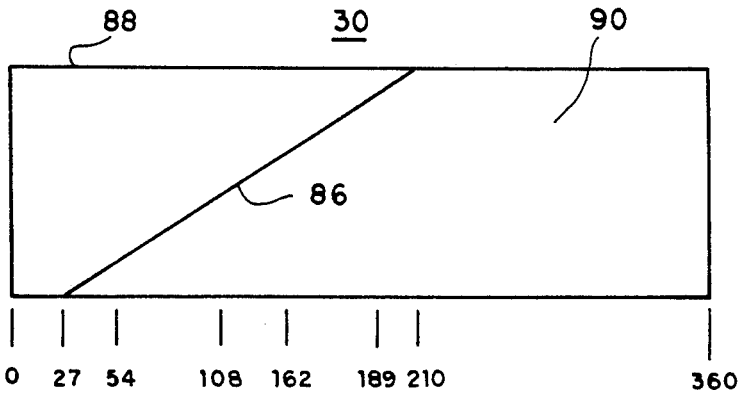
FIG. 3 is a cam profile diagram of the cam used in the inventive system.

Also keyed to rotate with shaft 32 while allowing shaft 32 to shift relative thereto is an encoder plate 44 mounted on hub 108 of pulley 40 and having a plurality of openings 46 thereon. A light source 48 shines light through the openings 46 to engage light receiver 50 which, through logic circuit 52, sends a signal over line 58 to programmable controller 54 (see FIG. 2) indicative of the speed (RPM) with which shaft 32 is rotating. Elements 48, 50 and 52 are mounted on a suitable bracket 56. While a specific encoder structure has been disclosed, other conventional encoder means may be substituted therefor.

Programmable controller 54 converts the RPM reading into a suitable axially shifted position for cam 30 and sends a signal to servo motor 60 over line 62, the signal indicating both the direction and duration of the rotation of screw-threaded shaft 64. Any conventional programmable controller may be used for controller 54 which will enable the described conversion. For example, a ROM may include a table of rotational speeds and corresponding axial positions for cam 30, enabling the selection of a particular position upon the identification of a particular rotational speed. Mounted on screw-threaded shaft 64 is a nut 66 which translates horizontally back and forth, depending upon the direction of rotation of servo motor 60 mounted on frame portion 68. Integral with nut 66 is a bearing portion 70 which is mounted on camshaft 32 between two flanges 72 integral with shaft 32. Bearing portion 70, together with bearing 74, support shaft 32 for rotation while allowing shaft 32 to be axially translatable relative to bearing 74. Upon rotation of screw-threaded shaft 64, nut 66 will be translated to the right or left in FIG. 1. Depending on the direction of translation of nut 66, bearing portion 70 will push on one or the other of the flanges 72 to shift shaft 32 to the right or left. This in turn shifts cam 30 relative to cam follower 76 which pivots about pivot axis 78. Cam follower 76 carries a shaft 80 which supports at the left end thereof a rectangular plate 82 which carries a first electrically heated sealing member 84 thereon, the purpose of which is to seal the seam on the long side of the thermoplastic wrap on the cigarette package 12. When cam follower 76 rides on the high portion of cam 30, cam follower 76 is pivoted counterclockwise about axis 78, and shaft 80, rectangular plate 82 and electrically heated sealing member 84 are also raised up away from cigarette package 12. As cam 30 rotates, cam follower 76 eventually drops to the low surface of the cam, which enables electrically heated sealing member 84 to engage cigarette package 12 for a period of time determined by the axial position of cam 30. The profile of cam 30 is cut so as to provide the exact amount of dwell degrees so as to enable the electrically heated sealing member 84 to contact the cigarette package with a constant time value for each RPM value from 45 RPM to 410 RPM. As the RPM values change, cam 30 is shifted to change the contact time accordingly.

Figure 4:
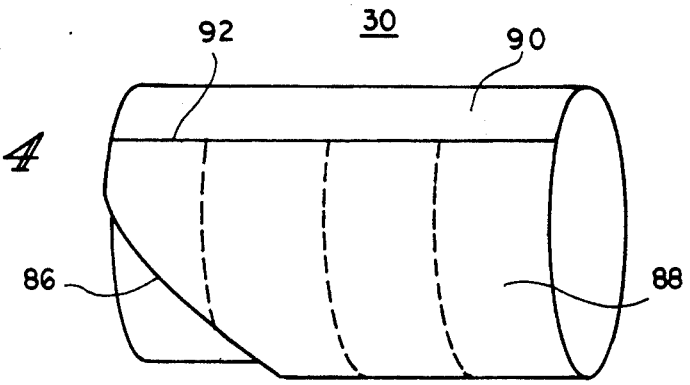
FIG. 4 is a perspective view of the cylindrical cam used in the inventive system.
Figure 5:
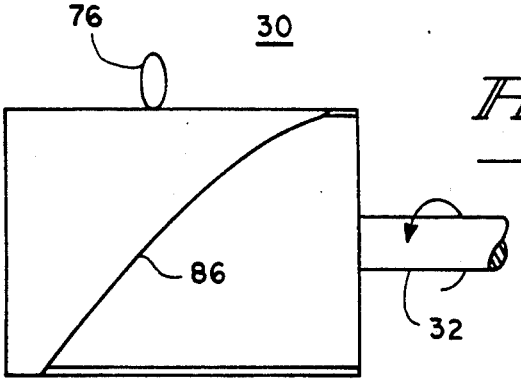
FIG. 5 is another view of the cylindrical cam used in the inventive system.
Figure 6:
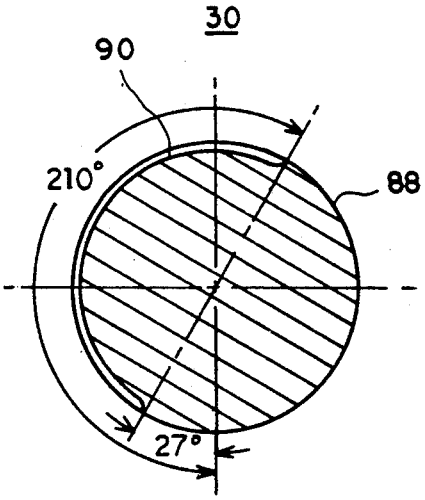
FIG. 6 is an end view of the cylindrical cam used in the inventive system.

As shown in FIGS. 3, 4, 5 and 6, the line 86 separating the high and low portions 88,90 of cam 30 follows a helical curve extending from 27 degrees of rotation to 210 degrees of rotation. As shown in FIG. 4, line 92 represents the transition between the low portion 90 back to the high portion 88. Each cycle of rotation of cam 30 begins with cam follower 76 riding on the high portion 88 in the vicinity of transition line 92, with the length of the contact time depending upon the circumferential length of the low portion 90 which, in turn, depends upon the axial position of the cam 30 determined by the rotational speed of the cam 30.

After the longitudinal side of cigarette package 12 has been sealed, seams or areas on the two ends of each cigarette package 12 still have to be sealed. This is done after the cigarette package 12 has been transferred from wrapping wheel 26 to an exiting station where electrically heated sealing members 94 and 96 can engage the ends of cigarette package 12, as shown in FIG. 1.

Through gearwheel 16, drive shaft 14 rotates a gear 98 on shaft 100 parallel with shaft 14. Connected to the left end of shaft 100 is a bevel gear 102 which meshes with a second bevel gear 104 which in turn has a splined connection with camshaft 106, whereby gear 104 can drive camshaft 106 to rotate about its longitudinal axis while allowing camshaft 106 to axially shift relative to gear 104 in a manner similar to camshaft 32 relative to pulley 40. Fixed to shaft 106 for rotation and axial shifting therewith is another cam 110 similar to cam 30 and having a high portion 112 and a low portion 114. Mounted on shaft 100 on the side of gear 98 opposite bevel gear 102 is another encoder plate 116 having openings 118 cooperating with a light source 48, light receiver 50 and logic circuit 52 to read the speed of rotation of shaft 100 in the same manner as described above for shaft 32. Logic circuit 52 sends the signals generated by encoder plate 116 to programmable controller 54 over line 120 which translates the RPM value into a suitable axially shifted position for cam 110 and sends a signal over line 122 to servo motor 124, the signal indicating both the direction and duration of rotation of screw-threaded shaft 126. Again, while a specific encoder structure has been disclosed, other conventional encoder means may be substituted therefor. Mounted on screw-threaded shaft 126 for axial translation along screw-threaded shaft 126 is a nut 128. Integral with nut 128 is a bearing portion 130 mounted on camshaft 106 between two flanges 132 integral with camshaft 106. As nut 128 translates along screw-threaded shaft 126, bearing portion 130 presses against one or the other of flanges 132 to thereby relocate cam 110 and shaft 106 in accordance with the RPM of shaft 100.

Cooperating with cam 110 is a cam follower 134 which is a two-arm lever that pivots about axis 136. Connected to cam follower 134 is a rod 138 which is also connected to a block 140 supporting electrically heated sealing member 94 for a seam on the rear end of cigarette package 12. Block 140 is also connected through a lever 142 to a horizontal shaft 144, which serves as a pivot for a two-armed lever 146. The front arm of two-armed lever 146 is provided with a pin 148 which is horizontal and is inserted in a slot 150 in one end of a lever 152. The rear arm of two-armed lever 146 is biased clockwise by a spring 154.

Lever 152 is biased upwardly by a spring 156 in counterclockwise direction about shaft 158 which is parallel with shaft 144. Shaft 158 is integral with block 160 which supports electrically heated sealing member 96 for a seam on the front of cigarette package 12.

Through the described mechanical connections, cam 110 causes electrically heated sealing members 94 and 96 to simultaneously approach the ends of each package 12 of cigarettes to provide a seam at each end of cigarette package 12.

When overwrapping machine 10 is in the process of starting or for some emergency reason is running at a speed below its rating, cams 30 and 110 are shifted axially so as to vary the contact time between cigarette package 12 and sealing members 84, 94 and 96.

While it will be apparent that the preferred embodiment of the invention herein disclosed is well calculated to fulfill the objects above-stated, it will be appreciated that the invention is susceptible to modification, variation and change without departing from the proper scope or fair meaning of the subjoined claims.

I claim:

1. In a machine for wrapping packages with a transparent thermoplastic overwrap having a heat sealed side seam and heat sealed end seams, said machine including a main driving shaft, receiving and positioning means intermittently driven by said main driving shaft for receiving and positioning said packages and said transparent thermoplastic overwrap for engagement with a first electrically heated sealing member to provide a side seam on said packages and for engagement with a second and a third electrically heated sealing member for providing end seams on said packages, and first and second cam follower means cooperating with first and second cam means to enable engagement of said first, second and third electrically heated sealing members with said side seam and said end seams, respectively, the improvement comprising:

first means for variably controlling contact time of said first electrically heated sealing member with said side seam in response to a variable rotational speed of a first rotatable camshaft means supporting said first cam means;

second means for variably controlling contact time of said second and third electrically heated sealing members with said end seams in response to a variable rotational speed of a second rotatable camshaft means supporting said second cam means;

said first and second cam means being cylinders having a surface cam formed on a cylinder wall, said surface cam having a transition zone between a high and a low surface of the cam in the form of a helix extending between 27 degrees of rotation and 210 degrees, whereby said contact time may be varied by axially shifting each said cylinder relative to a fixed cam follower;

said first and second rotatable camshaft means being operatively connected to said main driving shaft for continuous rotation of said first and second rotatable camshaft means;

said first and second means for variably controlling contact time comprising:

first and second encoder means operatively connected respectively to said first and second rotatable camshaft means to identify the rotational speed of said first and second rotatable camshaft means;

first and second logic circuit means responsive to said first and second encoder means, respectively, for transmitting a signal respectively from said first and second encoder means representative of rotational speed of said first and second rotatable camshaft means to a programmable controller means which converts said rotational speed signals to positioning signals representative of corresponding axial positions of said first and second rotatable camshaft means; and first and second reversible servo motor means respectively responsive to said positioning signals to axially shift said first and second rotatable camshaft means and the first and second cam means connected thereto relative to first and second fixed cam follower means; whereby the contact times of said first, second and third electrically heated sealing members are changed to correspond to the speed signals generated by the associated encoder means;

said first and second reversible servo motor means each comprising:

a rotatable threaded shaft means reversibly driven by a reversible servo motor;

nut means mounted on said rotatable threaded shaft means for translatory movement along said rotatable threaded shaft means when said rotatable threaded shaft means is rotated;

bearing means connected to said nut means and supporting said camshaft means for rotation;

said camshaft means including a pair of flanges integral with said camshaft means, said bearing means being mounted on said camshaft means between said flanges; whereby when said nut means travels along said threaded shaft means said bearing means bears on one of said flanges to shift said camshaft means to reposition said cam means relative to said cam follower means;

whereby said side seam and said end seams are neither undersealed nor oversealed regardless of the rotatable speed of the first and second rotatable camshaft means.

2. A machine for wrapping packages as in claim 1, wherein:

the operative connection between said first rotatable camshaft means and said main driving shaft comprises a first pulley on said main driving shaft, a second pulley on said first rotatable camshaft means, and a belt connecting said first and second pulleys;

said first encoder means includes an encoder plate means mounted on a hub of said second pulley to rotate with said second pulley and said first camshaft means;

said hub being slidably keyed to said first rotatable camshaft means to enable said first rotatable camshaft means to shift axially relative to said second pulley and said first encoder means; and the operative connection between said second rotatable camshaft means and said main driving shaft comprises:

a gearwheel on said main driving shaft meshing with a gear mounted on a shaft parallel to said main driving shaft;

a bevel gear mounted on one end of said parallel shaft meshing with a second bevel gear mounted on said second rotatable camshaft means, said second rotatable camshaft means being located transverse to said parallel shaft; and said second encoder means including an encoder plate means mounted on said parallel shaft.

3. In a machine for wrapping packages with a transparent thermoplastic overwrap having a heat sealed side seam and heat sealed end seams, said machine including a main driving shaft, receiving and positioning means intermittently driven by said main driving shaft for receiving and positioning said packages and said transparent thermoplastic overwrap for engagement with a first electrically heated sealing member to provide a side seam on said packages and for engagement with a second and a third electrically heated sealing member for providing end seams on said packages, and first and second cam follower means cooperating with first and second cam means to enable engagement of said first, second and third electrically heated sealing members with said side seam and said end seams, respectively, the improvement comprising:

first means for variably controlling contact time of said first electrically heated sealing member with said side seam in response to a variable rotational speed of a first rotatable camshaft means supporting said first cam means;

second means for variably controlling contact time of said second and third electrically heated sealing members with said end seams in response to a variable rotational speed of a second rotatable camshaft means supporting said second cam means;

the respective temperatures of said first, second and third electrically heated sealing members, and the respective pressures of said first, second and third electrically heated sealing members on said side and end seams are maintained constant;

said first and second cam means being cylinders having a surface cam formed on a cylinder wall, each said surface cam having a transition zone between a high and a low cam surface in the form of a helix extending between 27 degrees of rotation and 210 degrees of rotation, whereby said contact time may be varied by axially shifting each said cylinder relative to a respective fixed cam follower;

said first and second rotatable camshaft means being operatively connected to said main driving shaft for continuous rotation of said first and second rotatable camshaft means;

said first and second means for variably controlling contact time comprising:

first and second encoder means operatively connected respectively to said first and second rotatable camshaft means to identify the rotational speed of said first and second rotatable camshaft means;

first and second logic circuit means responsive to said first and second encoder means, respectively, for transmitting a signal respectively from said first and second encoder means representative of rotational speed of said first and second rotatable camshaft means to a programmable controller means which converts said rotational speed signals to positioning signals representative of corresponding axial positions of said first and second rotatable camshaft means; and first and second reversible servo motor means respectively responsive to said positioning signals to axially shift said first and second rotatable camshaft means and the first and second cam means connected thereto relative to first and second fixed cam follower means; whereby the contact times of said first, second and third electrically heated sealing members are changed to correspond to the speed signals generated by the associated encoder means;

said first and second reversible servo motor means each comprising:

a rotatable threaded shaft means reversibly driven by a reversible servo motor;

nut means mounted on said rotatable threaded shaft means for translatory movement along said rotatable threaded shaft means when said rotatable threaded shaft means is rotated;

bearing means connected to said nut means and supporting said camshaft means for rotation;

said camshaft means including a pair of flanges integral with said camshaft means, said bearing means being mounted on said camshaft means between said flanges; whereby when said nut means travels along said threaded shaft means said bearing means bears on one of said flanges to shift said camshaft means to reposition said cam means relative to said cam follower means;

whereby said side seam and said end seams are neither undersealed nor oversealed regardless of the rotatable speed of the first and second rotatable camshaft means.

4. A machine for wrapping packages as in claim 3, wherein:

the operative connection between said first rotatable camshaft means and said main driving shaft comprises a first pulley on said main driving shaft, a second pulley on said first rotatable camshaft means, and a belt connecting said first and second pulleys;

said first encoder means includes an encoder plate means mounted on a hub of said second pulley to rotate with said second pulley and said first camshaft means;

said hub being slidably keyed to said first rotatable camshaft means to enable said first rotatable camshaft means to shift axially relative to said second pulley and said first encoder means; and the operative connection between said second rotatable camshaft means and said main driving shaft comprises:

a gearwheel on said main driving shaft meshing with a gear mounted on a shaft parallel to said main driving shaft;

a bevel gear mounted on one end of said parallel shaft meshing with a second bevel gear mounted on said second rotatable camshaft means, said second rotatable camshaft means being located transverse to said parallel shaft; and said second encoder means including an encoder plate means mounted on said parallel shaft.

* * * * *